US009164462B2

(12) United States Patent
Nakamura et al.

(10) Patent No.: US 9,164,462 B2
(45) Date of Patent: Oct. 20, 2015

(54) IMAGE FORMING APPARATUS

(71) Applicants: Keigo Nakamura, Kanagawa (JP); Hirokazu Ishii, Kanagawa (JP); Yasunobu Shimizu, Kanagawa (JP); Hiromi Ogiyama, Tokyo (JP); Shinya Tanaka, Kanagawa (JP)

(72) Inventors: Keigo Nakamura, Kanagawa (JP); Hirokazu Ishii, Kanagawa (JP); Yasunobu Shimizu, Kanagawa (JP); Hiromi Ogiyama, Tokyo (JP); Shinya Tanaka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/287,639

(22) Filed: May 27, 2014

(65) Prior Publication Data

US 2014/0270830 A1 Sep. 18, 2014

Related U.S. Application Data

(63) Continuation of application No. 13/602,840, filed on Sep. 4, 2012, now Pat. No. 8,787,806.

(30) Foreign Application Priority Data

Sep. 13, 2011 (JP) ..... 2011-199245

(51) Int. Cl.
*G03G 15/16* (2006.01)
*G03G 15/00* (2006.01)

(52) U.S. Cl.
CPC ..... *G03G 15/6535* (2013.01); *G03G 15/1675* (2013.01); *G03G 15/6532* (2013.01); *G03G 2215/00772* (2013.01); *G03G 2215/00776* (2013.01)

(58) Field of Classification Search
None
See application file for complete search history.

(56) References Cited

U.S. PATENT DOCUMENTS 4,979,000 A 12/1990 Hamada et al.
5,408,300 A * 4/1995 Wataki et al. ..... 399/313
5,483,330 A 1/1996 Ogiyama et al.

(Continued)

FOREIGN PATENT DOCUMENTS

CN 1759353 A 4/2006
JP 63187266 A * 8/1988 ..... G03G 15/01

(Continued)

OTHER PUBLICATIONS

Translation of Tarumi S63-187266 (1988).*

(Continued)

*Primary Examiner* — David Gray
*Assistant Examiner* — Sevan A Aydin
(74) *Attorney, Agent, or Firm* — Oblon, McClelland, Maier & Neustadt, L.L.P.

(57) ABSTRACT

An image forming apparatus includes a transfer device to transfer a toner image formed on an image bearing member onto a recording medium, a sheet separation device to separate the recording medium from the image bearing member, a sheet separation bias application device to apply to the sheet separation device a sheet separation bias in which an alternating current (AC) component is superimposed on a direct current (DC) component, and a transfer bias application device to selectively apply to the transfer device one of a DC transfer bias having a DC component and a superimposed transfer bias in which an AC component is superimposed on a DC component. Upon application of the superimposed transfer bias to the transfer device, the sheet separation bias applied to the sheet separation device is changed from the sheet separation bias applied upon application of the DC transfer bias to the transfer device.

16 Claims, 3 Drawing Sheets

(56) References Cited

U.S. PATENT DOCUMENTS

| | | | | |
|---|---|---|---|---|
| 5,515,146 | A | 5/1996 | Harasawa et al. | |
| 5,523,834 | A | 6/1996 | Ito | |
| 5,526,106 | A | 6/1996 | Katsumi et al. | |
| 5,557,389 | A | 9/1996 | Sato et al. | |
| 5,621,504 | A | 4/1997 | Wakamatsu et al. | |
| 5,621,513 | A | 4/1997 | Pitts et al. | |
| 5,631,725 | A | 5/1997 | Harasawa et al. | |
| 5,633,703 | A * | 5/1997 | Takenouchi et al. | 399/315 |
| 5,812,919 | A | 9/1998 | Takano et al. | |
| 5,822,667 | A | 10/1998 | Hayama et al. | |
| 5,890,046 | A | 3/1999 | Amemiya et al. | |
| 5,923,935 | A * | 7/1999 | Yamaguchi | 399/297 |
| 5,930,573 | A | 7/1999 | Miyamoto et al. | |
| 6,188,862 | B1 | 2/2001 | Ishii | |
| 6,282,386 | B1 | 8/2001 | Ishii | |
| 2002/0034406 | A1 | 3/2002 | Kawagoe et al. | |
| 2003/0016968 | A1 | 1/2003 | Takahashi et al. | |
| 2003/0026625 | A1 | 2/2003 | Tamiya et al. | |
| 2003/0035658 | A1 | 2/2003 | Ishii | |
| 2003/0035660 | A1 | 2/2003 | Sugino et al. | |
| 2003/0118359 | A1 | 6/2003 | Ogiyama et al. | |
| 2003/0219287 | A1 | 11/2003 | Ogiyama et al. | |
| 2003/0219296 | A1 | 11/2003 | Kabata et al. | |
| 2004/0105692 | A1 | 6/2004 | Tamiya et al. | |
| 2004/0136760 | A1 | 7/2004 | Yoshida et al. | |
| 2005/0013636 | A1 | 1/2005 | Sawai et al. | |
| 2005/0180767 | A1 | 8/2005 | Ishii et al. | |
| 2006/0127116 | A1 | 6/2006 | Ogiyama et al. | |
| 2007/0003333 | A1 | 1/2007 | Ishii | |
| 2007/0014597 | A1 | 1/2007 | Ishii | |
| 2007/0127941 | A1 | 6/2007 | Ishii et al. | |
| 2007/0258737 | A1 * | 11/2007 | Ogiyama et al. | 399/315 |
| 2008/0232867 | A1 | 9/2008 | Minbu et al. | |
| 2009/0269114 | A1 * | 10/2009 | Yuge | 399/399 |
| 2010/0008687 | A1 | 1/2010 | Ishii | |
| 2010/0080631 | A1 | 4/2010 | Ogiyama et al. | |
| 2011/0229168 | A1 | 9/2011 | Shiraishi et al. | |
| 2012/0008991 | A1 | 1/2012 | Shimizu | |
| 2012/0045231 | A1 | 2/2012 | Ogino et al. | |
| 2012/0045237 | A1 | 2/2012 | Aoki et al. | |
| 2012/0045259 | A1 | 2/2012 | Nakamura et al. | |
| 2012/0170951 | A1 | 7/2012 | Ishii | |
| 2013/0136468 | A1 | 5/2013 | Shimizu et al. | |
| 2013/0148993 | A1 | 6/2013 | Aoki et al. | |
| 2013/0164011 | A1 | 6/2013 | Nakamura et al. | |
| 2013/0195483 | A1 | 8/2013 | Shimizu et al. | |
| 2013/0236201 | A1 | 9/2013 | Mizutani et al. | |

FOREIGN PATENT DOCUMENTS

| | | |
|---|---|---|
| JP | 4-086878 | 3/1992 |
| JP | 9-146381 | 6/1997 |
| JP | 10-078705 A | 3/1998 |
| JP | 11-084905 | 3/1999 |
| JP | 2003-263042 A | 9/2003 |
| JP | 2006-267486 | 10/2006 |
| JP | 2008-058585 | 3/2008 |
| JP | 2008-185890 | 8/2008 |

OTHER PUBLICATIONS

Translation of Tarumi, JP S63-187266 (1988).*

Office Action issued Nov. 3, 2014, in Chinese Patent Application No. 201210325364.8.

* cited by examiner

IMAGE FORMING APPARATUS

CROSS-REFERENCE TO RELATED APPLICATION

This patent application is a continuation application of U.S. patent application Ser. No. 13/602,840, filed Sep. 4, 2012, which claims priority pursuant to 35 U.S.C. §119 to Japanese Patent Application No. 2011-199245, filed on Sep. 13, 2011, in the Japanese Patent Office. The entire contents of the above applications are incorporated herein by reference.

BACKGROUND

1. Field

Exemplary aspects of the present inventions generally relate to an electrophotographic image forming apparatus, such as a copier, a facsimile machine, a printer, or a multifunctional system including a combination thereof.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photoconductive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

In recent years, a variety of recording media sheets such as paper having a luxurious, leather-like texture and Japanese paper known as "Washi" have come on the market. Such recording media sheets have a coarse surface through an embossing process to produce that luxurious impression. However, toner does not transfer well to such embossed surfaces, in particular the recessed portions of the surface. This improper transfer of the toner appears as dropouts or white spots in the resulting output image.

Various attempts have been made to prevent improper transfer of the toner under such circumstances. For example, according to JP-2008-185890-A, a recording medium is heated immediately before a toner image is transferred thereon, and the recording medium is charged with a polarity opposite that of the toner. In this configuration, a transfer electric field is enhanced so that the toner is transferred to the recessed portions of the recording medium. However, the desired transferability is still not achieved if the recessed portions are relatively deep.

In another approach, in order to prevent dropouts and obtain desired imaging quality, an alternating current (AC) voltage is superimposed on a direct current (DC) voltage to form a transfer bias. For example, in JP-2006-267486-A, a superimposed bias, in which an AC voltage is superimposed on a DC voltage, is used as the transfer bias, and the surface of the recording medium is charged with a polarity opposite that of the toner in accordance with the roughness of the surface prior to transfer.

The superimposed transfer bias may have several permutations. For example, In JP-2008-058585-A, as the transfer bias, the AC voltage is superimposed on the DC voltage such that a peak-to-peak voltage of the AC voltage is equal to or less than twice the DC voltage. In JP-H09-146381-A, a surface of an intermediate transfer member employs a fluorocarbon resin, and as the transfer bias, the AC voltage is superimposed on the DC voltage such that the peak-to-peak voltage of the AC voltage is 2.05 times the DC voltage or greater. In JP-H04-086878-A, as the transfer bias, the AC voltage is superimposed on the DC voltage such that the frequency of the AC voltage is 4 kHz or less and the number of cycles in a transfer nip is 20 or more.

Although the above-described approaches are advantageous and generally effective for the intended purpose, the level of the superimposed AC voltage is relatively low so that the toner does not transfer well onto the recessed portions of the recording media. In order to overcome this difficulty, as the transfer bias, the AC voltage is superimposed on the DC voltage, and the peak-to-peak value of the AC voltage can be 4 times the absolute value of the DC voltage. In this configuration, the transferability can be improved, but depending on the surface condition of recording media sheets, image defects including horizontal streaks still appear in an output image.

In view of the above, there is thus an unsolved need for an image forming apparatus capable of maintaining good transferability regardless of surface conditions of recording media sheets.

BRIEF SUMMARY OF THE INVENTION

In view of the foregoing, in an aspect of this disclosure, there is provided an improved image forming apparatus including an image bearing member, a transfer device, a sheet separation device, a sheet separation bias application device, and a transfer bias application device. The image bearing member bears a toner image on a surface thereof. The transfer device transfers the toner image onto a recording medium. The sheet separation device separates the recording medium bearing the toner image on the surface thereof from the image bearing member. The sheet separation bias application device is connected to the sheet separation device to apply to the sheet separation device a sheet separation bias in which an alternating current (AC) component is superimposed on a direct current (DC) component. The transfer bias application device is connected to the transfer device, to selectively apply to the transfer device one of a DC transfer bias having a DC component and a superimposed transfer bias in which an AC component is superimposed on a DC component. Upon application of the superimposed transfer bias to the transfer device, the sheet separation bias applied to the sheet separation device is changed from the sheet separation bias applied upon application of the DC transfer bias to the transfer device.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF DISCLOSED EMBODIMENTS

Figure 1:
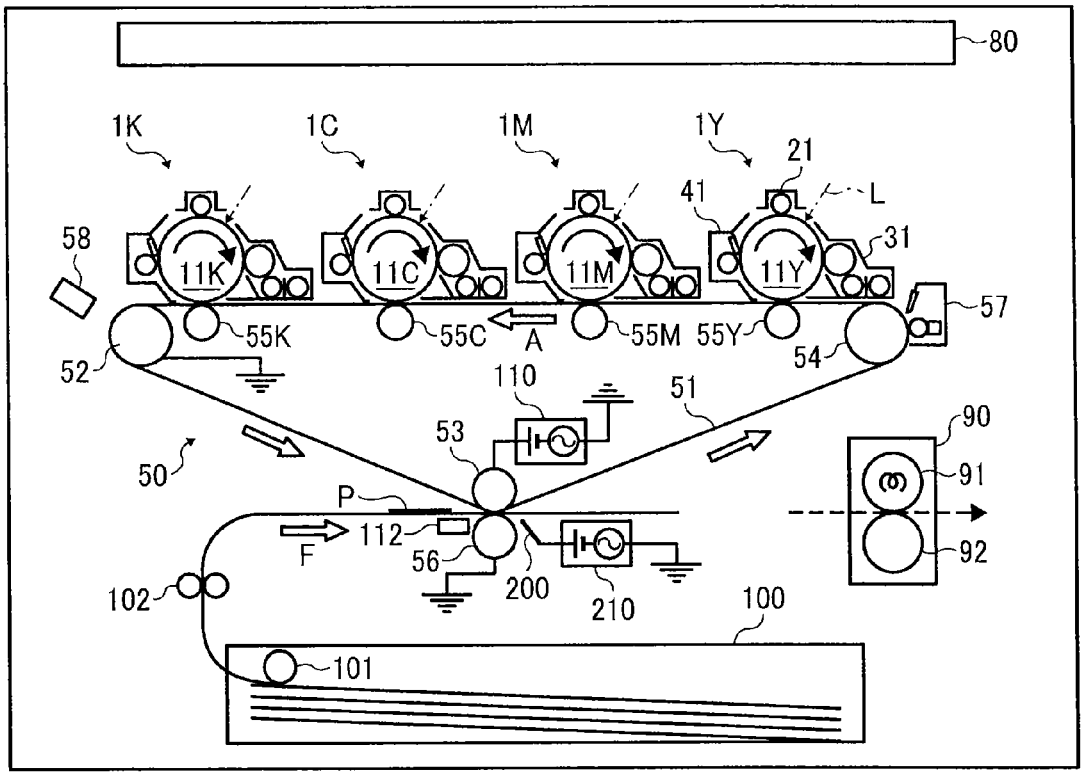
FIG. 1 is a cross-sectional diagram schematically illustrating a color printer as an example of an image forming apparatus according to an illustrative embodiment of the present invention.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an aspect of this disclosure. FIG. 1 is a schematic diagram illustrating a color printer as an example of the image forming apparatus according to an illustrative embodiment of the present invention.

The image forming apparatus shown in FIG. 1 uses an intermediate transfer method in which a toner image formed on an image bearing member is indirectly transferred onto a recording medium via an intermediate transfer member. According to the present illustrative embodiment, an intermediate transfer belt 51 serves as the intermediate transfer member.

As illustrated in FIG. 1, the image forming apparatus includes four image forming units 1Y, 1M, 1C, and 1K (which may be collectively referred to as image forming units 1), an optical writing unit 80, a transfer unit 50 including the intermediate transfer belt 51, a fixing device 90, and so forth. Substantially above the intermediate transfer belt 51, the image forming units 1Y, 1M, 1C, and 1K, one for each of the colors yellow, magenta, cyan, and black, are arranged in tandem in the direction of movement of the intermediate transfer belt 51 indicated by a hollow arrow A, thereby constituting a tandem imaging station.

It is to be noted that suffixes Y, M, C, and K denote the colors yellow, magenta, cyan, and black, respectively. To simplify the description, the suffixes Y, M, C, and K indicating colors are omitted herein unless otherwise specified.

Figure 2:
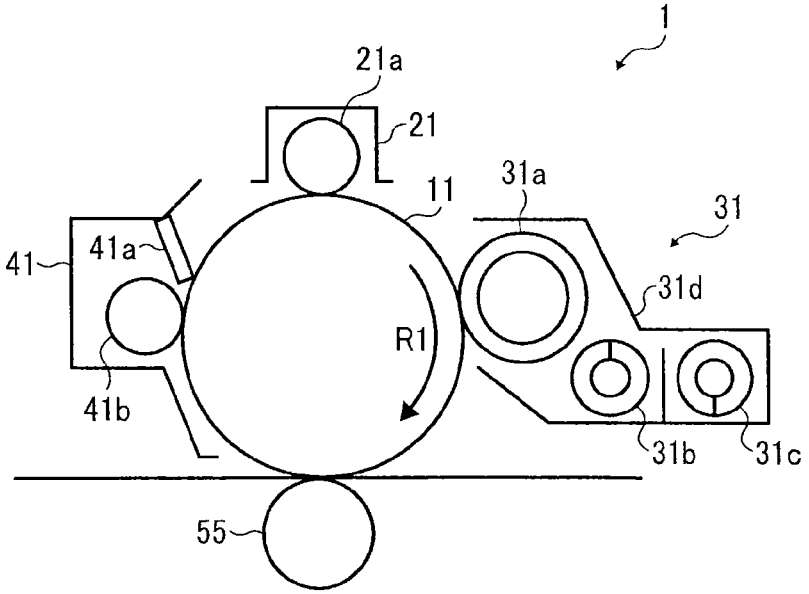
FIG. 2 is a schematic diagram illustrating an image forming unit employed in the image forming apparatus of FIG. 1.

With reference to FIG. 2, a description is provided of the image forming units 1Y, 1M, 1C, and 1K. FIG. 2 is a schematic diagram illustrating one of the image forming units 1. The image forming units 1Y, 1M, 1C, and 1K all have the same configuration as all the others, differing only in the color of toner employed. Thus, a description is provided of one of the image forming units 1Y, 1M, 1C, and 1K, and the suffixes indicating the colors are omitted.

As illustrated in FIG. 2, the image forming unit 1 includes a drum-shaped photosensitive member (hereinafter referred to as simply photosensitive drum) 11, a charging device 21, a developing device 31, a primary transfer roller 55, a cleaning device 41, and so forth. The charging device 21 charges the surface of the photosensitive drum 11 by using a charging roller 21*a*. The developing device 31 develops a latent image formed on the photosensitive drum 11 with a respective color of toner to form a visible image known as a toner image. The primary transfer roller 55 serving as a primary transfer member transfers the toner image from the photosensitive drum 11 to the intermediate transfer belt 51. The cleaning device 41 cleans the surface of the photosensitive drum 11 after primary transfer. According to the illustrative embodiment, the image forming units 1Y, 1M, 1C, and 1K are detachably attachable relative to a main body of the image forming apparatus.

The photosensitive drum 11 is constituted of a drum-shaped base on which an organic photosensitive layer is disposed. The outer diameter of the photosensitive drum 11 is approximately 60 mm. The photosensitive drum 11 is rotated in a clockwise direction indicated by an arrow R1 by a driving device, not illustrated.

The charging roller 21*a* of the charging device 21 is supplied with a charging bias. The charging roller 21*a* contacts or is disposed close to the photosensitive drum 11 to generate an electrical discharge therebetween, thereby charging uniformly the surface of the photosensitive drum 11. According to the present illustrative embodiment, the photosensitive drum 11 is uniformly charged with negative polarity which is the same polarity as the normal charge on toner.

As the charging bias, an alternating current (AC) voltage superimposed on a direct current (DC) voltage is employed. According to the present illustrative embodiment, the photosensitive drum 11 is charged by the charging roller 21*a* contacting or disposed near the photosensitive drum 11. Alternatively, a known charger may be employed.

The developing device 31 includes a developing sleeve 31*a*, and paddles 31*b* and 31*c* inside a developer container 31*d*. In the developer container 31*d*, a two-component developing agent consisting of toner particles and carriers is stored. The developing sleeve 31*a* serves as a developer bearing member and faces the photosensitive drum 11 via an opening of the developer container 31*d*. The paddles 31*b* and 31*c* mix the developing agent and deliver the developing agent to the developing sleeve 31*a*.

According to the present illustrative embodiment, the two-component developing agent is used. Alternatively, a single-component developing agent may be used.

The cleaning device 41 removes residual toner remaining on the surface of the photosensitive drum 11 after primary transfer. According to the present illustrative embodiment, the cleaning device 41 includes a cleaning blade 41*a* and a cleaning brush 41*b*. The cleaning blade 41*a* of the cleaning device 41 contacts the surface of the photosensitive drum 11 at a certain angle such that the leading edge of the cleaning blade 41*a* faces counter to the direction of rotation R1 of the photosensitive drum 11. The cleaning brush 41*b* rotates in the direction opposite to the direction of rotation R1 of the photosensitive drum 11 while contacting the photosensitive drum 11, thereby cleaning the surface of the photosensitive drum 11.

A charge neutralizing device removes residual charge remaining on the photosensitive drum 11 after the surface thereof is cleaned by the cleaning device 41 so that the surface of the photosensitive drum 11 is initialized in preparation for the subsequent imaging cycle.

Referring back to FIG. 1, a description is provided of the optical writing unit 80. The optical writing unit 80 for writing a latent image on each of the photosensitive drums 11Y, 11M, 11C, and 11K (which may be collectively referred to as photosensitive drums 11) is disposed above the image forming units 1Y, 1M, 1C, and 1K. It is to be noted that the suffixes Y, M, C, and K indicating colors are omitted when discrimination therebetween is not required.

Based on image information received from external devices such as a personal computer (PC), the optical writing unit 80 illuminates the photosensitive drums 11Y, 11M, 11C, and 11K with a light beam projected from a laser diode of the optical writing unit 80. Accordingly, the electrostatic latent images of yellow (Y), magenta (M), cyan (C), and black (K) are formed on the photosensitive drums 11Y, 11M, 11C, and 11K, respectively. More specifically, the potential of the portion of the uniformly-charged surface of the photosensitive drums 11 illuminated with the light beam is attenuated. The potential of the illuminated portion of the photosensitive drum 11 with the light beam is less than the potential of the other area, that is, a background portion (non-image formation area), thereby forming an electrostatic latent image on the surface of the photosensitive drum 11.

The optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning the photosensitive drum 11. Alternatively, the optical writing unit 80 may employ a light source using an LED array including a plurality of LEDs that projects light.

Still referring to FIG. 1, a description is provided of the transfer unit 50. The transfer unit 50 is disposed below the image forming units 1Y, 1M, 1C, and 1K. The transfer unit 50 includes the intermediate transfer belt 51 serving as an image bearing member formed into an endless loop and entrained about a plurality of rollers, thereby rotating endlessly in the counterclockwise direction indicated by a hollow arrow A. The transfer unit 50 also includes a driving roller 52, a secondary transfer roller 53, a cleaning auxiliary roller 54, four primary transfer rollers 55Y, 55M, 55C, and 55K (which may be referred to collectively as primary transfer rollers 55), a nip forming roller 56, a belt cleaning device 57, an electric potential detector 58, and so forth.

The primary transfer rollers 55Y, 55M, 55C, and 55K (which may be collectively referred to as primary transfer rollers 55) are disposed opposite the photosensitive drums 11Y, 11M, 11C, and 11K, respectively, via the intermediate transfer belt 51. It is to be noted that the suffixes Y, M, C, and K indicating colors are omitted, unless otherwise specified.

The intermediate transfer belt 51 is entrained around and stretched taut between the driving roller 52, the secondary transfer roller 53, the cleaning auxiliary roller 54, and the primary transfer rollers 55, all disposed inside the loop formed by the intermediate transfer belt 51. The driving roller 52 is rotated by a driving device (not illustrated), enabling the intermediate transfer belt 51 to move in the direction of arrow A.

The intermediate transfer belt 51 is made of resin such as polyimide resin in which carbon is dispersed and has a thickness in a range of from 20 μm to 200 μm, preferably, approximately 60 μm. The volume resistivity thereof is in a range of from 1 e6 [Ω·cm] to 1 e12 [Ω·cm], preferably, approximately 1 e9 [Ω·cm]. The volume resistivity is measured with an applied voltage of 100V by a high resistivity meter, Hiresta UPMCPHT 45 manufactured by Mitsubishi Chemical Corporation.

The intermediate transfer belt 51 is interposed between the photosensitive drums 11Y, 11M, 11C, and 11K, and the primary transfer rollers 55Y, 55M, 55C, and 55K. Accordingly, primary transfer nips are formed between the front surface (image bearing surface) of the intermediate transfer belt 51 and the photosensitive drums 11Y, 11M, 11C, and 11K contacting the intermediate transfer belt 51. The primary transfer rollers 55 are applied with a primary transfer bias by a transfer bias power source, thereby generating a transfer electric field between the toner images on the photosensitive drums 11 and the primary transfer rollers 55.

Accordingly, the toner images are transferred primarily from the photosensitive drums 11 onto the intermediate transfer belt 51 due to the transfer electric field and a nip pressure at the primary transfer nip. More specifically, the toner images of yellow, magenta, cyan, and black are transferred onto the intermediate transfer belt 51 so that they are superimposed one atop the other, thereby forming a composite toner image on the intermediate transfer belt 51.

In the case of monochrome imaging, a support plate supporting the primary transfer rollers 55Y, 55M, and 55C of the transfer unit 50 is moved to separate the primary transfer rollers 55Y, 55M, and 55C from the photosensitive drums 11Y, 11M, and 11C. Accordingly, the front surface of the intermediate transfer belt 51, that is, the image bearing surface, is separated from the photosensitive drums 11Y, 11M, and 11C so that the intermediate transfer belt 51 contacts only the photosensitive drum 11K. In this state, only the image forming unit 1K is activated to form a toner image of black on the photosensitive drum 11K.

Each of the primary transfer rollers 55 comprises an elastic roller including a metal cored bar on which a conductive sponge layer is fixated. The outer diameter of the primary transfer roller 55 is approximately 16 mm. The diameter of the metal cored bar is approximately 10 mm.

The resistance of the sponge layer is measured such that a metal roller having an outer diameter of 30 mm is pressed against the sponge layer at a load of 10[N] and the current is measured when a voltage of 1000V is supplied to the metal cored bar of the primary transfer roller 55. Accordingly, the resistance R is obtained using Ohm's law: R=V/I, where V is a voltage, I is a current, and R is a resistance. The obtained resistance R of the sponge layer is approximately 3 E7Ω. A primary transfer bias is applied to the primary transfer rollers 55 with constant current control.

According to the illustrative embodiment, a roller-type transfer device (here, the primary transfer rollers 55) is used as a primary transfer device. Alternatively, a transfer charger or a brush-type transfer device may be employed as a primary transfer device.

As illustrated in FIG. 1, the nip forming roller 56 of the transfer unit 50 is disposed outside the loop formed by the intermediate transfer belt 51, opposite the secondary transfer roller 53 which is disposed inside the loop. The intermediate transfer belt 51 is interposed between the secondary transfer roller 53 and the nip forming roller 56. Accordingly, a secondary transfer nip is formed between the peripheral surface or the image bearing surface of the intermediate transfer belt 51 and the nip forming roller 56 contacting the surface of the intermediate transfer belt 51.

The nip forming roller 56 is grounded; whereas, the secondary transfer roller 53 is supplied with a secondary transfer bias by a secondary transfer bias power source 110. With this configuration, a secondary transfer electric field is formed between the secondary transfer roller 53 and the nip forming roller 56 so that the toner moves electrostatically from the secondary transfer roller side to the nip forming roller side.

As illustrated in FIG. 1, a sheet cassette 100 storing a stack of recording media sheets P is disposed below the transfer unit 50. The sheet cassette 100 is equipped with a sheet feed roller 101 to contact a top sheet of the stack of recording media sheets P. As the sheet feed roller 101 is rotated at a predetermined speed, the sheet feed roller 101 picks up the top sheet and feeds it to a sheet passage in the image forming apparatus.

Substantially at the end of the sheet passage, a pair of registration rollers 102 is disposed. The pair of the registration rollers 102 stops rotating temporarily, immediately after the recording medium P delivered from the sheet cassette 100 is interposed therebetween. The pair of registration rollers 102 starts to rotate again to feed the recording medium P to the secondary transfer nip in appropriate timing such that the recording medium P is aligned with a composite or monochrome toner image formed on the intermediate transfer belt 51 in the secondary transfer nip.

In the secondary transfer nip, the recording medium P tightly contacts the composite or the monochrome toner image on the intermediate transfer belt 51, and the composite or the monochrome toner image is transferred secondarily onto the recording medium P due to the secondary transfer electric field and the nip pressure applied thereto.

After the recording medium P on which the composite or monochrome toner image is transferred passes through the secondary transfer nip, the recording medium P separates from the nip forming roller 56 and the intermediate transfer belt 51 due to the curvature of the nip forming roller 56 and the intermediate transfer belt 51, also known as self stripping.

The secondary transfer roller 53 comprises a metal cored bar on which a conductive NBR rubber layer is provided. The outer diameter of the secondary transfer roller 53 is approximately 24 mm. The diameter of the metal cored bar is approximately 16 mm. The resistance R of the conductive NBR rubber layer is in a range of from 1 e6 [Ω] to 1 e12 [Ω], preferably, approximately 4 E7 [Ω]. The resistance R is measured using the same method as the primary transfer roller 55 described above.

The nip forming roller 56 comprises a metal cored bar on which a conductive NBR rubber layer is provided. The outer diameter of the nip forming roller 56 is approximately 24 mm. The diameter of the metal cored bar is approximately 14 mm. The resistance R of the conductive NBR rubber layer is equal to or less than 1 E6Ω. The resistance R is measured using the same method as the primary transfer roller 55 described above.

As illustrated in FIG. 1, a sheet separation device 200 is disposed downstream from the secondary transfer nip in the direction of transport of the recording medium (right side in FIG. 1). According to the present illustrative embodiment, the sheet separation device 200 includes a charge eliminating needle having a serrated shape, extending in the direction of the shaft of the nip forming roller 56. A bias power source 210 for separation of the recording medium supplies the charge eliminating needle with a separation bias. The bias power source 210 employs a high voltage power source having the same configuration as the secondary transfer bias power source 110.

The electric potential detector 58 is disposed outside the loop formed by the intermediate transfer belt 51, opposite the driving roller 52 which is grounded. More specifically, the electric potential detector 58 faces a portion of the intermediate transfer belt 51 entrained around the driving roller 52 with a gap of approximately 4 mm. The surface potential of the toner image primarily transferred onto the intermediate transfer belt 51 is measured when the toner image comes to the position opposite the electric potential detector 58. According to the present embodiment, as the electric potential detector 58, a surface potential sensor EFS-22D manufactured by TDK Corp. is used.

On the right hand side of the secondary transfer nip between the secondary transfer roller 53 and the intermediate transfer belt 51, the fixing device 90 is disposed. The fixing device 90 includes a fixing roller 91 and a pressing roller 92. The fixing roller 91 includes a heat source such as a halogen lamp inside thereof. While rotating, the pressing roller 92 pressingly contacts the fixing roller 91, thereby forming a heated area called a fixing nip therebetween. The recording medium P bearing an unfixed toner image on the surface thereof is conveyed to the fixing device 90 and interposed between the fixing roller 91 and the pressing roller 92 in the fixing device 90. Under heat and pressure, the toner adhered to the toner image is softened and fixed to the recording medium P in the fixing nip. Subsequently, the recording medium P is discharged outside the image forming apparatus from the fixing device 90 along the sheet passage after fixing.

According to the illustrative embodiment, the secondary transfer bias power source 110 serving as a secondary transfer bias output device includes a direct current (DC) power source that outputs a direct current (DC) voltage (hereinafter referred to as DC bias), and an alternating current (AC) power source that outputs a superimposed bias as the secondary transfer bias, that is, an alternating current (AC) voltage superimposed on a DC voltage. It is to be noted that the secondary transfer bias power source 110 can operate constant-current control.

An output terminal of the secondary transfer bias power source 110 is connected to the metal cored bar of the secondary transfer roller 53. The potential of the metal cored bar of the secondary transfer roller 53 has almost the same value as the output voltage from the secondary transfer bias power source 110. As for the nip forming roller 56, the metal cored bar of the nip forming roller 56 is grounded. According to the present illustrative embodiment, the nip forming roller 56 is grounded while the superimposed bias is supplied to the metal cored bar of the secondary transfer roller 53.

Alternatively, the secondary transfer roller 53 may be grounded while the superimposed bias is supplied to the metal cored bar of the nip forming roller 56. In this case, the polarity of the DC voltage is changed. More specifically, as illustrated in FIG. 1, in a case in which the superimposed bias is applied to the secondary transfer roller 53 while toner having negative polarity is used and the nip forming roller 56 is grounded, the DC voltage having the same negative polarity as the toner is used so that a time-averaged potential of the superimposed bias has the same negative polarity as the toner.

By contrast, in a case in which the secondary transfer roller 53 is grounded and the superimposed bias is applied to the nip forming roller 56, the DC voltage having positive polarity opposite to the polarity of toner is used so that the time-averaged potential of the superimposed bias has the positive polarity opposite to the polarity of toner.

Instead of applying the superimposed bias to the secondary transfer roller 53 or the nip forming roller 56, the DC voltage may be supplied to one of the secondary transfer roller 53 and the nip forming roller 56, and the AC voltage may be supplied to the other roller.

Figure 3:
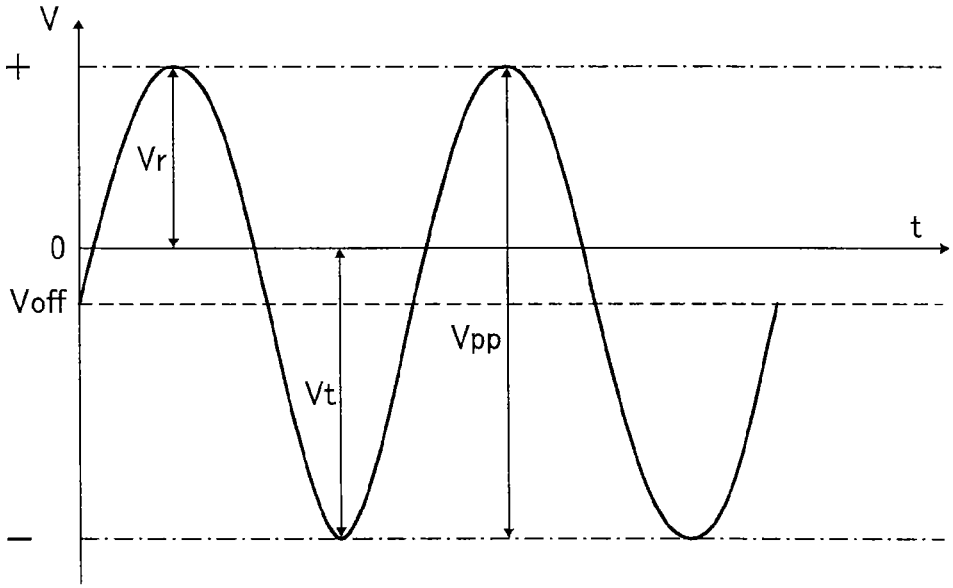
FIG. 3 is a waveform chart showing an example of a waveform of a superimposed bias provided by a secondary transfer bias power source employed in the image forming apparatus.

According to the present illustrative embodiment, a sine wave AC voltage as shown in FIG. 3 is used. Alternatively, a rectangular wave AC voltage may be used. When using a normal sheet of paper, such as the one having a relatively smooth surface, a pattern of dark and light according to the surface conditions of the sheet is less likely to appear on the recording medium. In this case, the transfer bias composed only of the DC voltage is supplied. By contrast, when using a recording medium having a rough surface such as pulp paper, the transfer bias needs to be changed from the transfer bias composed only of the DC voltage to the superimposed bias.

After the intermediate transfer belt 51 passes through the secondary transfer nip, residual toner not having been transferred onto the recording medium remains on the intermediate transfer belt 51. The residual toner is removed from the intermediate transfer belt 51 by the belt cleaning device 57 which contacts the surface of the intermediate transfer belt 51. The cleaning auxiliary roller 54 disposed inside the loop formed by the intermediate transfer belt 51 supports cleaning operation by the belt cleaning device 57 from inside the loop of the intermediate transfer belt 51 so that the residual toner on the intermediate transfer belt 51 is removed reliably.

As described above, according to the illustrative embodiment, the secondary transfer bias is applied to the metal cored bar of the secondary transfer roller 53. The secondary transfer bias power source 110 serving as a voltage output device serves as a transfer bias application device that supplies a transfer bias.

When the secondary transfer bias is applied to the metal cored bar of the secondary transfer roller 53, a potential difference is generated between the metal cored bar of the secondary transfer roller 53 and the metal cored bar of the nip forming roller 56. In other words, the secondary transfer bias power source 110 serves also as a potential difference generator. In general, a potential difference is treated as an absolute value. However, in this specification, the potential difference is expressed with polarity. More specifically, a value obtained by subtracting the potential of the metal cored bar of the nip forming roller 56 from the potential of the metal cored bar of the secondary transfer roller 53 is considered as the potential difference.

Using toner having the negative polarity as in the illustrative embodiment, when the polarity of the time-averaged value of the potential difference becomes negative, the potential of the nip forming roller 56 is increased beyond the potential of the secondary transfer roller 53 on the opposite polarity side to the polarity of charge on the toner (the positive side in the present embodiment). Accordingly, the toner is electrostatically moved from the secondary transfer roller side to the nip forming roller side.

With reference to FIG. 3, a description is provided of the secondary transfer bias using the superimposed bias. FIG. 3 is a waveform chart showing an example of the waveform of the superimposed bias output from the secondary transfer bias power source 110.

In FIG. 3, an offset voltage Voff is a value of a direct current component of the superimposed bias. A peak-to-peak voltage Vpp is an alternating current component of the peak-to-peak voltage of the superimposed bias. According to the illustrative embodiment, the superimposed bias is composed of the superimposed voltage of the offset voltage Voff and the peak-to-peak voltage Vpp as described above. Thus, the time-averaged value of the superimposed voltage coincides with the value of offset voltage Voff.

As described above, according to the illustrative embodiment, the secondary transfer bias is applied to the metal cored bar of the secondary transfer roller 53 while the metal cored bar of the nip forming roller 56 is grounded (0V). Thus, the potential of the metal cored bar of the secondary transfer roller 53 itself becomes the potential difference between the potentials of the metal cored bar of the secondary transfer roller 53 and the metal cored bar of the nip forming roller 56.

The potential difference between the potentials of the metal cored bar of the secondary transfer roller 53 and the metal cored bar of the nip forming roller 56 includes a direct current component (Eoff) having the same value as the offset voltage Voff and an alternating current component (Epp) having the same value as the peak-to-peak voltage (Vpp).

According to the present illustrative embodiment, as illustrated in FIG. 3, the polarity of the offset voltage Voff is negative. When the polarity of the offset voltage Voff of the secondary transfer bias applied to the secondary transfer roller 53 is negative, the toner having negative polarity can be moved relatively from the secondary transfer roller side to the nip forming roller side. If the polarity of the secondary transfer bias is negative so is the polarity of the toner, the toner of negative polarity is moved electrostatically from the secondary transfer roller side to the nip forming roller side in the secondary transfer nip. Accordingly, the toner on the intermediate transfer belt 51 is transferred onto the recording medium P.

By contrast, if the polarity of the secondary transfer bias is opposite to the polarity of toner, that is, the polarity of the secondary transfer bias is positive, the toner having negative polarity is attracted electrostatically to the secondary transfer roller side from the nip forming roller side. Consequently, the toner transferred to the recording medium P is attracted again to the intermediate transfer belt 51.

It is to be noted that because the time-averaged value of the secondary transfer bias (the same value as the offset voltage Voff in the present embodiment) has negative polarity, the toner is moved electrostatically from the secondary transfer roller side to the nip forming roller side, relatively. In FIG. 3, a return peak potential Vr represents a positive peak value having polarity opposite to that of toner.

As described above, the transferability of toner relative to a recording medium having a coarse surface can be enhanced by using a transfer bias in which the AC voltage is superimposed on the DC voltage, and the peak-to-peak voltage of the AC voltage is four times the absolute value of the DC voltage or greater. Although effective, depending on the surface conditions of a recording medium, image defects such as pitch unevenness may appear as horizontal streaks in an output image.

The level of the AC component of the secondary transfer bias and the sheet separation bias, as well as characteristics of the recording medium may cause pitch unevenness such as horizontal streaks.

With the large AC component of the secondary transfer bias or the large AC component of the sheet separation bias, electric charge accumulates on the rear surface of the recording medium and the belt surface. As a result, an electrical discharge occurs cyclically, thereby causing reverse charging of toner which results in the pitch unevenness.

In another case in which pitch unevenness may appear in the output image, electric charge accumulates cyclically so that the potential difference becomes small and the transferability drops significantly at the charged portion, thereby causing image defects in an output image.

As the AC component of the secondary transfer bias and the separation bias increases, the electrical charge to be accumulated also increases proportional to the AC component. Therefore, in order to reduce or prevent accumulation of the electrical charge, either the AC component of the secondary transfer bias or the AC component of the separation bias needs to be reduced. However, reducing the AC component of the secondary transfer bias degrades the transferability relative to the recording medium having a coarse surface. Thus, the AC component of the separation bias, rather than the AC component of the secondary transfer bias, is reduced to prevent the pitch unevenness.

The image defects such as described above appear more frequently on the recording medium with a relatively low sheet resistivity. This is because the current that flows through the recording medium with a low sheet resistance increases when the AC voltage is supplied.

Figure 4:
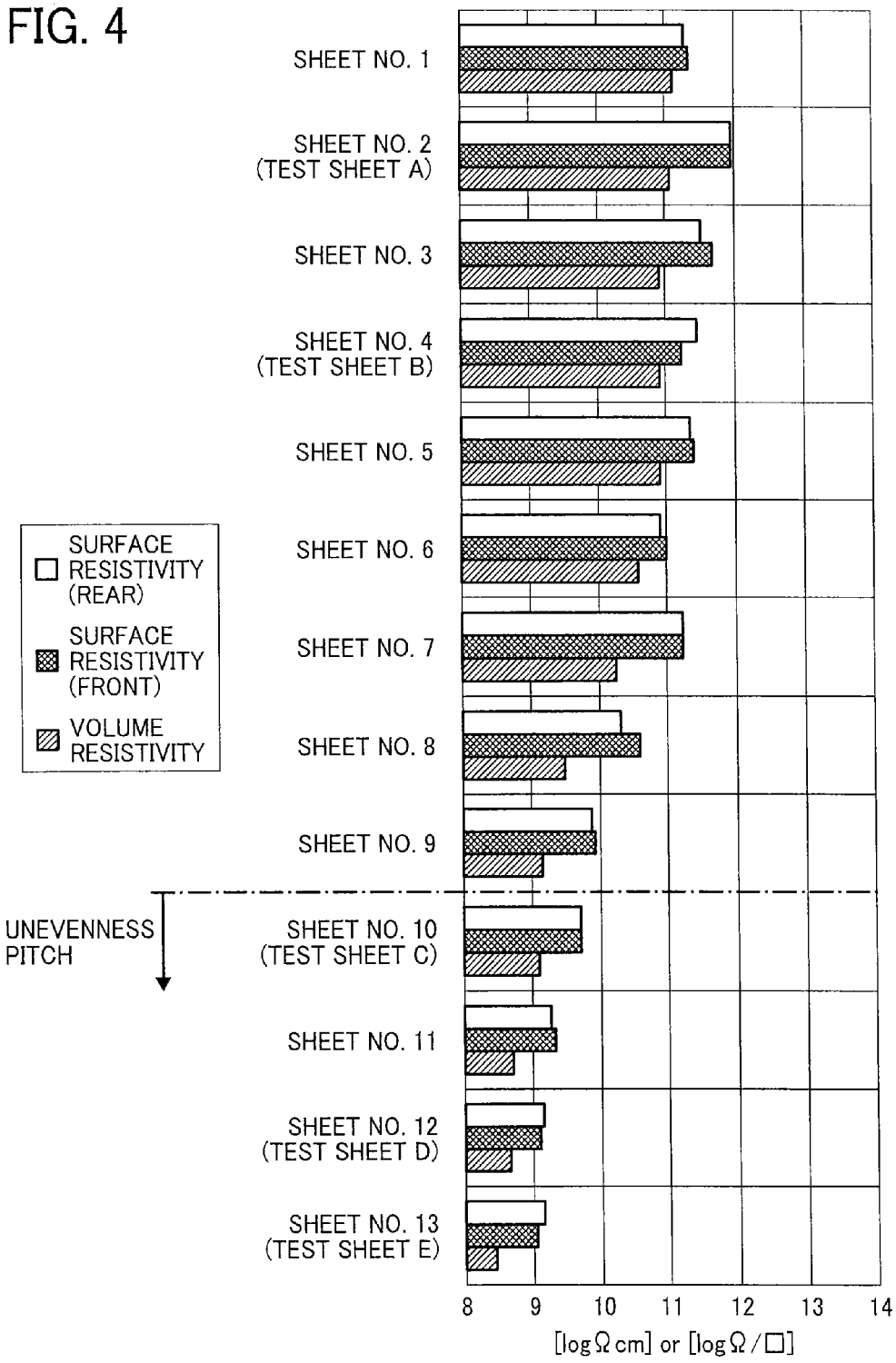
FIG. 4 is a graph showing a measured surface resistivity and a volume resistivity of different kinds of recording media sheets having a coarse surface.

FIG. 4 shows the measured surface resistivity and the volume resistivity for different kinds of recording media sheets having a coarse surface. As illustrated in FIG. 4, the surface resistivity of a recording medium differs significantly depending on the characteristics of recording media sheets. As can be seen in FIG. 4, the highest surface resistivity is approximately at least 100 times greater than the lowest surface resistivity.

According to experiments using the sheets shown in FIG. 4 performed by the present inventors, horizontal-streak pitch unevenness appeared when the surface resistivity of the recording medium was equal to or less than approximately 10 [log Ω], and the volume resistivity was equal to or less than approximately 9.2 [log Ω]. It is to be noted that the surface resistivity was measured in accordance with Japanese Industrial Standard (JIS-K6911) in which a voltage of 500 V was applied for 10 seconds. The test sheets were left for 10 hours in an environment with the temperature of 23° C. and the relative humidity of 50%.

Referring to FIG. 4, a sheet No. 9 had a volume resistivity of 9.18 [log Ω], a surface resistivity (front) of 9.92 [log Ω], and a surface resistivity (rear) of 9.89 [log Ω]. A sheet No. 10 had a volume resistivity of 9.12 [log Ω], a surface resistivity (front) of 9.75 [log Ω], and a surface resistivity (rear) of 9.71 [log Ω]. No pitch unevenness appeared on the sheet No. 9, but pitch unevenness appeared on the sheet No. 10 and above (No. 11 to 13).

These values change depending on the configurations of image forming apparatuses. Hence, the threshold resistivity at which pitch unevenness appears may differ depending on the machine.

In a case in which the resistivity of the sheet was less than a predetermined value, good imaging quality was achieved by reducing the alternating current component of the sheet separation bias.

However, simply reducing the separation bias may cause a paper jam if the sheet is relatively thin, that is, the sheet has a low basis weight. More specifically, as a sheet having a low basis weight exits the transfer nip, the sheet does not separate properly from the intermediate transfer belt or the secondary transfer roller (here, the nip forming roller 56), hence causing a paper jam.

The purpose of using the alternating current component as the secondary transfer bias is to enhance transferability of toner to the recessed portions on the sheet having a coarse surface. Therefore, only when using the sheet having a coarse surface, the alternating current component (the superimposed bias) is supplied as the secondary transfer bias while reducing the sheet separation bias.

With this configuration, good imaging quality can be achieved with respect to the sheet having a coarse surface. As for other kinds of sheets, good imaging quality is achieved by applying the direct current bias as the secondary transfer bias while separating the sheet properly.

Interference of the transfer bias and the sheet separation bias may occur even when using a normal sheet. According to the results of experiments performed by the present inventors, when the AC voltage was intentionally raised, interference of the transfer bias and the separation bias occurred with the normal sheet, hence generating pitch unevenness. However, for the normal sheet, the transferability can be enhanced using a lower voltage than the voltage used for the sheet with a coarse surface, which means that the voltage does not need to be raised as high as the level that causes the interference. Thus, pitch unevenness is less likely to appear on the normal sheet.

Next, a description is provided of the experiments performed by the present inventors.

A test machine having the same configurations as the image forming apparatus shown in FIG. 1 was used for the experiments. Various printing tests were performed using the test machine. The secondary transfer bias and the sheet separation bias were applied such that a direct current component was supplied with a constant current and an alternating current component was supplied with a constant voltage. The alternating current component was supplied with the constant voltage because constant-current control of amplitude of voltage Vpp of the alternating current component is difficult. In other words, the amplitude is easy to control with constant-voltage control.

In Comparative Example 1, the following base values were used for the DC current and the AC voltage (peak-to-peak). The secondary transfer bias: a DC current −60 [μA], an AC voltage Vpp 7.0 [kV], and a frequency 500 [Hz]. The sheet separation bias: a DC current 1 [μA], an AC voltage Vpp 9.0 [kV], and a frequency 1 [kHz].

The frequency of the AC voltage of the secondary transfer bias was different from that of the sheet separation bias. This is because if the frequency of the AC voltage of the sheet separation bias is low, streaks appear. In order to prevent the streaks from appearing in the image, the frequency of the AC voltage for the sheet separation bias was relatively high.

It is to be noted that a power source for the frequency of 1 [kHz] for general use is available at low cost.

In the experiments, the linear velocity was changed for different sheet thicknesses. For example, for the sheet having the basis weight of 220 gsm or less, the linear velocity was 352.8 mm/s. For the sheet having the basis weight of greater than 220 gsm, the linear velocity was 246.96 mm/s.

5 different kinds of test sheets A through E were used as recording media, and a half-tone image was output on these test sheets under the conditions of Comparative Example 1 described above and the illustrative embodiment of the present invention. Image defects such as horizontal-streak pitch unevenness were evaluated visually. It is to be noted that the test sheets A through E were selected from the sheets shown in FIG. 4.

The test sheets were fed under the conditions of Comparative Example 1, Embodiment 1, and Embodiment 2 at room temperature and normal humidity. In Embodiment 1, the secondary transfer bias was the same as Comparative Example 1, but the Vpp of the AC voltage of the sheet separation bias was 3.0 [kV]. In Embodiment 2, the secondary transfer bias was the same as Comparative Example 1, but the Vpp of the AC voltage of the sheet separation bias was off (Vpp=0 kV).

In order to maintain a uniform condition of a developing agent, after a test image having an image area ratio of approximately 9% for each color was printed on 250 sheets, the half-tone image was printed on 5 sheets and evaluated. It is to be noted that the output image was graded such that when no image defect was observed, it was graded as "GOOD". When image defects such as pitch unevenness were observed, it was graded as "POOR". The results are shown in TABLE 1.

TABLE 1

| | COMPARATIVE EXAMPLE 1 | EMBODIMENT 1 | EMBODIMENT 2 |
|---|---|---|---|
| TEST SHEET A | GOOD | GOOD | GOOD |
| TEST SHEET B | GOOD | GOOD | GOOD |
| TEST SHEET C | POOR | GOOD | GOOD |
| TEST SHEET D | POOR | GOOD | GOOD |
| TEST SHEET E | POOR | POOR | GOOD |

As shown in TABLE 1, as compared with Comparative Example 1, in Embodiment 1 and the Embodiment 2, the number of sheets that exhibited the image defects was less than Comparative Example 1. This indicates that the present invention was effective.

Next, with reference to TABLE 2, a description is provided of results of experiments on a paper jam. Whether or not a paper jam occurs when using normal thin paper was evaluated.

The following sheets were used in the experiments: Normal sheet F as thin paper having the base weight of 52.3 gsm; the sheet A having a coarse surface with a relatively high resistivity; and the sheet E having a coarse surface with a relatively low resistivity. Here, a high resistivity refers to a resistivity equal to or greater than 9.7 log Ω/□; whereas, a low resistivity refers to a resistivity less than 9.7 log Ω/□, for example.

It is to be noted that a sheet having a coarse surface herein refers, for example, to embossed paper or also known as textured paper including, but not limited to, Leathac (registered trademark) and linen paper, having a maximum embossed groove depth in a range of from approximately 60 μm to 200 μm.

The test sheets were fed under the conditions of Comparative Example 1, Comparative Example 2, Embodiment 1, Embodiment 2, and Embodiment 3 at room temperature and normal humidity. In TABLE 2, in Comparative Example 2, the secondary transfer bias was a DC bias (DC component only), and the sheet separation bias was the same as Comparative Example 1. In Embodiment 3, at a time during which the sheet having a coarse surface passed through the transfer nip, the secondary transfer bias was the same as Comparative Example 1, and the AC voltage of the sheet separation bias was off (Vpp=0 kV). In Embodiment 3, as for the normal sheet, the secondary transfer bias was the DC bias (DC component only), and the AC voltage of the sheet separation bias was off (Vpp=0 kV) similar to Comparative Example 2.

The evaluation was made such that when 25 blank sheets were fed and there was no paper jam, it was graded as "GOOD". When there was a paper jam, it was graded as "POOR". When there was no paper jam but an image defect or irregular density was observed, it was graded as "FAIR". The results are shown in TABLE 2.

TABLE 2

| | COMPARATIVE EXAMPLE 1 | COMPARATIVE EXAMPLE 2 | EMBODIMENT 3 |
|---|---|---|---|
| NORMAL SHEET F | GOOD | GOOD | POOR |
| TEST SHEET A | FAIR | GOOD | GOOD |
| TEST SHEET B | FAIR | FAIR | GOOD |

As shown in TABLE 2, reducing the AC voltage of the sheet separation bias at a time during which the normal sheet passed through the nip causes a paper jam. However, if the AC voltage of the sheet separation bias is not reduced for the sheet with a coarse surface, image defects may be generated. Therefore, the separation bias is changed depending on the characteristics of the sheets to prevent a paper jam as well as image defects.

In view of the above, when applying the superimposed bias as the transfer bias, the sheet separation bias is changed (adjusted) to prevent image defects such as pitch unevenness, thereby achieving good imaging quality.

According to the illustrative embodiments, in a case in which a normal sheet is fed, the DC bias is applied as the secondary transfer bias and the superimposed bias is applied as the sheet separation bias. With this configuration, adequate transferability is achieved while separating the recording media sheets reliably and hence preventing a paper jam.

In a case in which a sheet having a coarse surface is fed, the superimposed bias in which the alternating current component is superimposed on the direct current component is applied as the secondary transfer bias and the AC voltage of the sheet separation bias is reduced. With this configuration, image defects can be prevented while achieving the desired transferability with respect to the sheet having a coarse surface.

It is to be noted that, in general, the sheet having a coarse surface has relatively good separability by itself. Hence, even when the AC voltage of the sheet separation bias is reduced, a paper jam is less likely to occur.

With reference to TABLE 3, a description is provided of experiments in which image defects and separability of sheets were evaluated with different levels of AC component of the separation bias (different Vpp values).

Images were output on the normal sheet F and the test sheets C and D described above with different levels of AC component of the separation bias. It is to be noted that, the secondary transfer bias was the same as the Comparative Example 1 and fixed, and an image was output. Image defects such as pitch unevenness were evaluated on the test sheets C and D. The image defects as well as separability were evaluated on the normal sheet F.

Similar to the experiments above, the half-tone image was output to evaluate the image defects. Blank sheets were fed to evaluate the separability. TABLE 3 shows the results of the experiment.

TABLE 3

| SHEET | | | NORMAL SHEET F | |
|---|---|---|---|---|
| SEPARATION | LOW RESISTIVITY SHEET | | PITCH | SHEET |
| BIAS (Vpp) | TEST SHEET C | TEST SHEET D | UNEVENNESS | SEPARABILITY |
| 11 k | POOR | POOR | POOR | GOOD |
| 10 k | POOR | POOR | POOR | GOOD |
| 9 k | POOR | POOR | GOOD | GOOD |
| 8 k | POOR | POOR | GOOD | GOOD |
| 7 k | GOOD | POOR | GOOD | GOOD |
| 6 k | GOOD | POOR | GOOD | POOR |
| 5 k | GOOD | GOOD | GOOD | POOR |
| 4 k | GOOD | GOOD | GOOD | POOR |
| 3 k | GOOD | GOOD | GOOD | POOR |
| 2 k | GOOD | GOOD | GOOD | POOR |
| 1 k | GOOD | GOOD | GOOD | POOR |
| 0 | GOOD | GOOD | GOOD | POOR |

As shown in TABLE 3, the lowest level of the separation bias at which the pitch unevenness appeared differs between the test sheets C and D. As for the normal sheet F, reducing the separation bias below a certain level (in this example, 6 kV or less) causes an abnormality in sheet separation (a paper jam). Moreover, similar to the test sheets C and D, increasing the separation bias causes horizontal-streak pitch unevenness on the normal sheet F.

According to the results of the experiments, it was confirmed that when using the superimposed bias as the transfer bias, reducing the sheet separation bias more than when using the DC bias could produce a good image without the image defects. Furthermore, it was confirmed also that adjusting the sheet separation bias in accordance with the characteristics of sheets could produce a good image with reliable separability.

Next, a description is provided of control of the sheet separation bias to accommodate environmental changes.

Possible causes for fluctuations in resistivity of parts and sheets include environmental changes. By adjusting the sheet separation bias based on the results of detection of temperature and humidity, good imaging quality can be achieved regardless of the environment.

When performing the above control, a detector 112 for detecting the temperature and the humidity is disposed near the nip forming roller 56 so that the temperature and the humidity near the secondary transfer portion can be detected. The results are provided to a control unit of the image forming apparatus, and conditions of the environment are determined.

According to the present illustrative embodiment, absolute humidity is used as a baseline for the temperature and the humidity. The absolute humidity can be obtained from the temperature and the relative humidity using the following equation.

$$\text{ABSOLUTE HUMIDITY}[\text{kg/g}^3] = \frac{217 \times \left(6.11 \times 10^{\left(7.5 \times \frac{t}{t+237.3}\right)}\right)}{t + 273.15} \times \text{RELATIVE HUMIDITY} \times 0.01 \quad \text{[EQUATION 1]}$$

The absolute humidity in a normal environment with the temperature 23° C. and humidity of 50% is 10.30.

According to the illustrative embodiment, the absolute humidity in the normal environment (the temperature 23° C. and humidity 50%) is used as a reference. The sheet separation bias is adjusted in accordance with the absolute humidity at the time of operation.

According to the present illustrative embodiment as described above, the sheet separation bias is adjusted in accordance with the absolute humidity. Alternatively, the sheet separation bias is adjusted when the change in the temperature and the relative humidity exceeds a certain range.

The sheet D was fed in different environmental conditions such as in the normal environment (temperature 23° C., humidity 50%), in a low-temperature, low-humidity environment (temperature 10° C., humidity 15%), and in a high-temperature, high-humidity environment (temperature 27° C., humidity 80%). Similar to the foregoing embodiments, in order to maintain a uniform condition of the developing agent, after the test image having an image area ratio of approximately 9% for each color was printed on 250 sheets, the half-tone image was printed on 5 sheets and evaluated visually.

The same transfer bias and the sheet separation bias as the Comparative Example 1 were used. The images were output with different levels of voltages of the AC component of the sheet separation bias. FIG. 4 shows the results of the experiments. In FIG. 4, "MM" refers to the normal environment, "HH" refers to the high-temperature, high-humidity environment, and "LL" refers to the low-temperature, low-humidity environment.

TABLE 4

| SHEET SEPARATION | TEST SHEET D | | |
|---|---|---|---|
| BIAS (Vpp) | MM | HH | LL |
| 11 k | POOR | POOR | POOR |
| 10 k | POOR | POOR | POOR |
| 9 k | POOR | POOR | POOR |
| 8 k | POOR | POOR | POOR |
| 7 k | POOR | POOR | GOOD |
| 6 k | POOR | POOR | GOOD |
| 5 k | GOOD | POOR | GOOD |
| 4 k | GOOD | GOOD | GOOD |
| 3 k | GOOD | GOOD | GOOD |
| 2 k | GOOD | GOOD | GOOD |
| 1 k | GOOD | GOOD | GOOD |
| 0 | GOOD | GOOD | GOOD |

As shown in TABLE 4, in the low-temperature, low-humidity environment (LL), the level of the alternating current component (Vpp) of the sheet separation bias at which pitch unevenness appeared was higher than the normal environment (MM). In the high-temperature, high-humidity environment (HH), even when the level of the alternating current component (Vpp) of the sheet separation bias is low, pitch unevenness appeared. This means that a necessary (optimum) sheet separation bias depends on the environment.

As can be understood from these results, good imaging quality is achieved regardless of the environment by adjusting the sheet separation bias based on the detected environmental conditions.

It is to be noted that an amount of an actual correction of the sheet separation bias (the level of the sheet separation bias to be determined based on the detected environmental conditions) can be set in accordance with the characteristics of parts, the level of biases, and so forth employed in the actual machine in use.

Referring back to FIG. 2, a description is provided of the developing device 31. The image forming units 1Y, 1M, 1C, and 1K all have the same configuration as all the others, differing only in the color of toner employed. Thus, a description is provided of one of the image forming units 1Y, 1M, 1C, and 1K, and the suffix indicating the color is omitted.

The developing device 31 includes a developing section including a developing roller 31*a* and a developer conveyer 31*d*. The developer conveyer 31*d* mixes a developing agent and feeds the developing agent to the developing roller 31*a*. The developer conveyer 31*d* includes a first chamber equipped with a first screw 31*b* and a second chamber equipped with a second screw 31*c*. The first screw 31*b* and the second screw 31*c* are each constituted of a rotatable shaft and helical flighting wrapped around the circumferential surface of the shaft. Each end of the shaft of the first screw 31*b* and the second screw 31*c* in the axial direction is rotatably held by shaft bearings.

The first chamber with the first screw 31*b* and the second chamber with the second screw 31*c* are separated by a wall, but each end of the wall in the direction of the screw shaft has a connecting hole through which the first chamber and the second chamber are connected. The first screw 31*b* mixes the developing agent by rotating the helical flighting and carries the developing agent from the distal end to the proximal end of the screw in the direction perpendicular to the surface of the recording medium while rotating.

The first screw 31*b* is disposed parallel to and facing the developing roller 31*a*. Hence, the developing agent is delivered along the axial (shaft) direction of the developing roller 31*a*. The first screw 31*b* supplies the developing agent to the surface of the developing roller 31*a* along the direction of the shaft line of the developing roller 31*a*.

The developing agent transported near the proximal end of the first screw 31*b* passes through the connecting hole in the wall near the proximal side and enters the second chamber. Subsequently, the developing agent is carried by the helical flighting of the second screw 31*c*. As the second screw 31*c* rotates, the developing agent is delivered from the proximal end to the distal end in FIG. 2 while being mixed in the direction of rotation.

In the second chamber, a toner density detector for detecting a density of toner in the developing agent is disposed at the bottom of a casing of the chamber. As the toner density detector, a magnetic permeability detector is employed. There is a correlation between the toner density and the magnetic permeability of the developing agent consisting of toner and magnetic carrier. Therefore, the magnetic permeability detector can detect the density of the toner.

Although not illustrated, the image forming apparatus includes toner supply devices to supply independently toner of yellow, magenta, cyan, and black to the second chamber of the respective developing device 31.

The control unit of the image forming apparatus includes a Random Access Memory (RAM) to store a target output voltage Vtref for output voltages provided by the toner density detectors for yellow, magenta, cyan, and black. If the difference between the output voltages provided by the toner detectors for yellow, magenta, cyan, and black and Vtref for each color exceeds a predetermined value, the toner supply devices are driven for a predetermined time period corresponding to the difference to supply toner. Accordingly, the respective color of toner is supplied to the second chamber of the developing device 31.

The developing roller 31*a* in the developing section faces the first screw 31*b* as well as the photosensitive drum 11 through an opening formed in the casing of the developing device 31. The developing roller 31*a* comprises a cylindrical developing sleeve made of a non-magnetic pipe which is rotated, and a magnetic roller disposed inside the developing sleeve. The magnetic roller is fixed to prevent the magnetic roller from rotating together with the developing sleeve. The developing agent supplied from the first screw 31*b* is carried on the surface of the developing sleeve by the magnetic force of the magnetic roller. As the developing sleeve rotates, the developing agent is transported to a developing area facing the photosensitive drum 11.

The developing sleeve is supplied with a developing bias having the same polarity as toner. The developing bias is greater than the bias of the electrostatic latent image on the photosensitive drum 11, but less than the charging potential of the uniformly charged photosensitive drum 11. With this configuration, a developing potential that causes the toner on the developing sleeve to move electrostatically to the electrostatic latent image on the photosensitive drum 11 acts between the developing sleeve and the electrostatic latent image on the photosensitive drum 11.

A non-developing potential acts between the developing sleeve and the non-image formation areas of the photosensitive drum 11, causing the toner on the developing sleeve to move to the sleeve surface. Due to the developing potential and the non-developing potential, the toner on the developing sleeve moves selectively to the electrostatic latent image formed on the photosensitive drum 11, thereby forming a visible image, known as a toner image.

The configuration of the transfer portion is not limited to the configuration described above. The opposing roller may be substituted by a belt member. According to the foregoing illustrative embodiments, the transfer method includes forming a nip at which two opposing members meet and press against each other to transfer a toner image.

The foregoing embodiments relate to the intermediate transfer method in which the intermediate transfer belt serves as an image bearing member onto which a toner image is transferred. The present invention is not limited to the intermediate transfer method described above. For example, the present invention can be applied to a direct transfer method in which a toner image formed on the photosensitive member (i.e. a photosensitive drum) is transferred directly onto a recording medium by applying a transfer bias to a transfer device (i.e. a transfer roller) facing or contacting the photosensitive member. In this case, the photosensitive member serves as an image bearing member. Alternatively, a contact-free method using a charger may be employed instead of forming a transfer nip. A known power source may be employed within the scope of the disclosure.

The configuration of the image forming apparatus is not limited to the configuration described above. The order of image forming units arranged in tandem is not limited to the above described order. The present invention may be applicable to an image forming apparatus using toners in three different colors or less. For example, the present invention may be applicable to a multi-color image forming apparatus using two colors of toner and a monochrome image forming apparatus.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member;

a transfer device;

a transfer bias power source that outputs, during a transfer process, one of a DC bias having a DC component and a superimposed bias having a superimposed AC component and DC component, to the transfer device to transfer a toner image from the image bearing member onto a sheet;

a separation device that performs a separation process to separate the sheet from the image bearing member; and a separation bias power source that outputs, during the separation process, a separation bias to the separation device, wherein the separation bias power source outputs a first separation bias when the transfer bias power source outputs the DC bias, and the separation bias power source outputs a second separation bias that is different from the first separation bias when the transfer bias power source outputs the superimposed bias.

2. The image forming apparatus according to claim 1, wherein the separation bias includes an AC voltage.

3. The image forming apparatus according to claim 1, wherein an AC voltage of the second separation bias is less than that of the first separation bias.

4. The image forming apparatus according to claim 3, wherein the AC voltage of the second separation bias is zero.

5. The image forming apparatus according to claim 1, wherein an amplitude of the second separation bias is less than that of the first separation bias.

6. The image forming apparatus according to claim 1, wherein the separation bias includes a separation AC component and a separation DC component, the separation AC component is constant-voltage controlled, and the separation DC component is constant-current controlled.

7. The image forming apparatus according to claim 1, further comprising a temperature/humidity detector that detects ambient temperature and humidity, wherein the separation bias is adjusted based on a detection result detected by the temperature/humidity detector.

8. The image forming apparatus of claim 1, wherein the second separation bias includes a DC component.

9. An image forming apparatus, comprising:

an intermediate transfer belt that bears a toner image;

a transfer roller that forms a transfer nip between the transfer roller and the intermediate transfer belt;

a transfer bias power source that outputs, during a transfer process, one of a DC bias having a DC component and a superimposed bias having a superimposed AC component and DC component, to transfer the toner image onto a sheet at the transfer nip;

a charge-eliminating needle disposed downstream from the transfer nip in a direction of transport of the sheet; and a charge-eliminating power source that outputs, during a separation process, a charge-eliminating bias to the charge-eliminating needle, wherein the charge-eliminating power source outputs a first charge-eliminating bias when the transfer bias power source outputs the DC bias, and the charge-eliminating power source outputs a second charge-eliminating bias that is different from the first charge-eliminating bias when the transfer bias power source outputs the superimposed bias.

10. The image forming apparatus according to claim 9, wherein the charge-eliminating bias includes an AC voltage.

11. The image forming apparatus according to claim 9, wherein an AC voltage of the second charge-eliminating bias is less than that of the first charge-eliminating bias.

12. The image forming apparatus according to claim 11, wherein the AC voltage of the second charge-eliminating bias is zero.

13. The image forming apparatus according to claim 9, wherein an amplitude of the second charge-eliminating bias is less than that of the first charge-eliminating bias.

14. The image forming apparatus of claim 9, wherein the change-eliminating bias includes an AC component and a DC component, the AC component is constant-voltage controlled, and the DC component is constant-current controlled.

15. The image forming apparatus of claim 9, further comprising a temperature/humidity detector that detects ambient temperature and humidity, wherein the charge-eliminating bias is adjusted based on a detection result detected by the temperature/humidity detector.

16. The image forming apparatus of claim 9, wherein the second charge-eliminating bias includes a DC component.

* * * * *